US005685764A

United States Patent [19]

Kostritzky

[11] Patent Number: 5,685,764

[45] Date of Patent: Nov. 11, 1997

[54] EXERCISE GARMENT WITH SUPPORT BRA

[76] Inventor: Angela Kostritzky, Apartment C, 209 Columbus Ave., New York, N.Y. 10023

[21] Appl. No.: 437,040

[22] Filed: May 8, 1995

[51] Int. Cl.[6] ..... A41B 9/08; A41B 11/00; A41C 3/08

[52] U.S. Cl. ..... 450/7; 450/22; 2/409; 2/300; 2/303; 2/305; 2/306; 2/310

[58] Field of Search ..... 2/107, 112, 117, 2/400, 401, 402, 403, 404, 405, 406, 407, 408, 409, 300, 303, 305, 306, 310, 311, 307; 450/6, 4, 5, 7, 8, 9, 10, 12, 13, 14, 15, 16, 17, 18, 19, 22, 23, 1

[56] References Cited

U.S. PATENT DOCUMENTS

| | | | |
|---|---|---|---|
| Re. 33,406 | 10/1990 | Wior . | |
| 2,023,612 | 12/1935 | Park et al. | 450/88 |
| 2,274,382 | 2/1942 | Richman | 2/73 |
| 2,587,911 | 3/1952 | Sider | 450/22 X |
| 2,598,759 | 6/1952 | Calde | 2/312 |
| 3,292,629 | 12/1966 | Steinberger | 2/73 X |
| 3,327,714 | 6/1967 | Steinberger | 2/73 |
| 4,372,320 | 2/1983 | Silber . | |
| 4,741,719 | 5/1988 | Wirth . | |
| 5,038,414 | 8/1991 | Freeman | 2/409 |
| 5,083,316 | 1/1992 | Kuehner . | |
| 5,097,537 | 3/1992 | Ewing | 2/409 |
| 5,109,546 | 5/1992 | Dicker . | |
| 5,153,944 | 10/1992 | Teel | 2/227 X |
| 5,159,716 | 11/1992 | Takata . | |
| 5,182,812 | 2/1993 | Goldsby | 2/227 X |
| 5,189,736 | 3/1993 | Price . | |

FOREIGN PATENT DOCUMENTS

| | | | |
|---|---|---|---|
| 1205600 | 9/1970 | United Kingdom | 2/312 |

*Primary Examiner*—Jeanette E. Chapman
*Attorney, Agent, or Firm*—Cammarata & Grandinetti

[57] ABSTRACT

The invention is an exercise garment having an integrally formed support bra. The exercise garment includes an upper bra portion for providing support to the user. Connected to the upper portion is a lower, stretchable fabric portion for covering the torso of the user. The upper and lower portions are joined at an elastic support member disposed below the breasts of the user. The upper and lower portions of the garment cooperate with each other so that each portion maintains its position on a user during vigorous exercise or dance.

3 Claims, 2 Drawing Sheets

EXERCISE GARMENT WITH SUPPORT BRA

BACKGROUND OF THE INVENTION

1. Field of the Invention

The invention relates generally to garments and clothing. In particular, the invention relates to garments adapted for use during dancing, exercise, or other vigorous activity.

2. Description of the Background Art

In recent years, the public in general, and women in particular, have become considerably more conscience of leading healthy lifestyles. Public health authorities agree that an important component of a healthy lifestyle is regular, vigorous exercise. Accordingly, many types of exercise have become extremely popular with both men and women. Examples of such vigorous exercise include aerobic exercise, "step aerobics", and running or jogging. Many individuals have also found that dance, whether ballet, modern, or other types, is also an excellent form of exercise.

The number and type of athletic accessories, such as foundational garments, external garments, and footwear available for a particular exercise has increased dramatically as organized exercise has become more prevalent. Footwear makers, for example, have diversified their product offerings to the point where it is now commonplace for one to purchase numerous pairs of different athletic shoes wherein each different pair is specialized for a particular sport or purpose. Exercise garment makers are also beginning to specialize product offerings as the makers learn the deficiencies of their products when used in certain activities.

For example, in the field of women's foundational exercise garments, such as undergarments, a need was perceived for bras capable of providing comfortable support during exercise. The foundational garments popularly known as the "jogbra" or the "sportbra" have proven both effective and popular, particularly for running, jogging, and biking. These products provide adequate support during exercise as well as sufficient coverage to serve as a fashionable outer garment.

Unfortunately, these products are not well adapted for all manners of exercise or activity. For example, during vigorous exercise or dancing, particularly involving either repeated rapid arm movements or repeated bending at the waist, these products tend to "ride upwards" and move towards the shoulders. This movement can result in discomfort and the inconvenience of requiring repeated adjustments of the bra. Support can be completely compromised, resulting in injury, embarrassment, or both.

Garments adapted for use on the lower torso and legs, such as tights and leotards, are not always completely effective during vigorous exercise. Repeated, rapid bending and stretching, aided by gravity, causes a phenomenon similar to that observed with bras. The tights tend to ride or roll downwards over the hips. Tights and leotards also tend to bunch and/or collect in an uncomfortable manner. While the likelihood for injury from these garments is lower than with a bra, the potential for embarrassment is substantially greater. Desirable exercise undergarments are sufficiently light and/or sheer so as to be easily worn under other formfitting garments or costumes, such as those garments used by professional dancers.

There exists a need in the industry for an exercise garment which provides support during exercise without experiencing the failures inherent in other types of exercise undergarments.

SUMMARY OF THE INVENTION

The invention is a one-piece support garment. The garment includes an upper-torso member or "upper portion" and a lower-torso member or "lower portion". The upper-torso member has a front to provide cups. The upper-torso member is made from an elastic or stretchable fabric. The lower-torso member provides a panty. The garment also includes a connecting member. The connecting member joins the upper-torso member and the lower-torso member. The connecting member and upper-torso member provide a bra and the connecting member enables the upper-torso member and the lower-torso member to cooperate under stress to maintain their respective positions on a user. The stress is, typically, one or more pulling forces occurring during vigorous exercise or dance by a user of the garment.

The preferred embodiment of the invention is an elastic support undergarment. The elastic support undergarment has the components of a flat continuous elastic band, an upper-torso breast support member, and a lower-torso member. The upper-torso breast support member provides a bra and is connected to the flat continuous elastic band. The lower-torso member provides a panty and is connected to the flat continuous elastic band. The upper-torso breast support member and the lower-torso member cooperate through the flat continuous elastic band to maintain their respective positions on a user during stretching or exercise. The upper portion and the lower portion are desirably joined at the elastic support member.

DETAILED DESCRIPTION OF THE INVENTION

The invention is a one-piece stretchable support garment having an upper portion and a lower portion. The upper portion and the lower portion are desirably joined at the elastic support member. The garment can be used as an undergarment during exercise. The garment includes an upper portion for fully or partially covering the chest of a user wearing the garment. The upper portion can be substantially bra-like, and includes an elastic support member such as an elastic band. The upper portion has a front and back for encircling a user's torso below the breasts. The upper portion also includes a stretchable fabric breast support extending upwardly from the front of the elastic support member and terminating at the back of the support member.

The garment also includes a stretchable fabric lower portion for covering the user's lower torso. The lower portion desirably covers a user's lower torso, legs, and feet.

The inventor has found that during vigorous exercise, movement causes traditional independent upper garments and lower garments to move away from optimal positions on the user's body. This movement compromises the effectiveness of the garments. The same forces that cause traditional garments to move over the body during vigorous exercise cause the upper portion and the lower portion of the invention to cooperate with each other and to maintain their positions.

Figure 1:
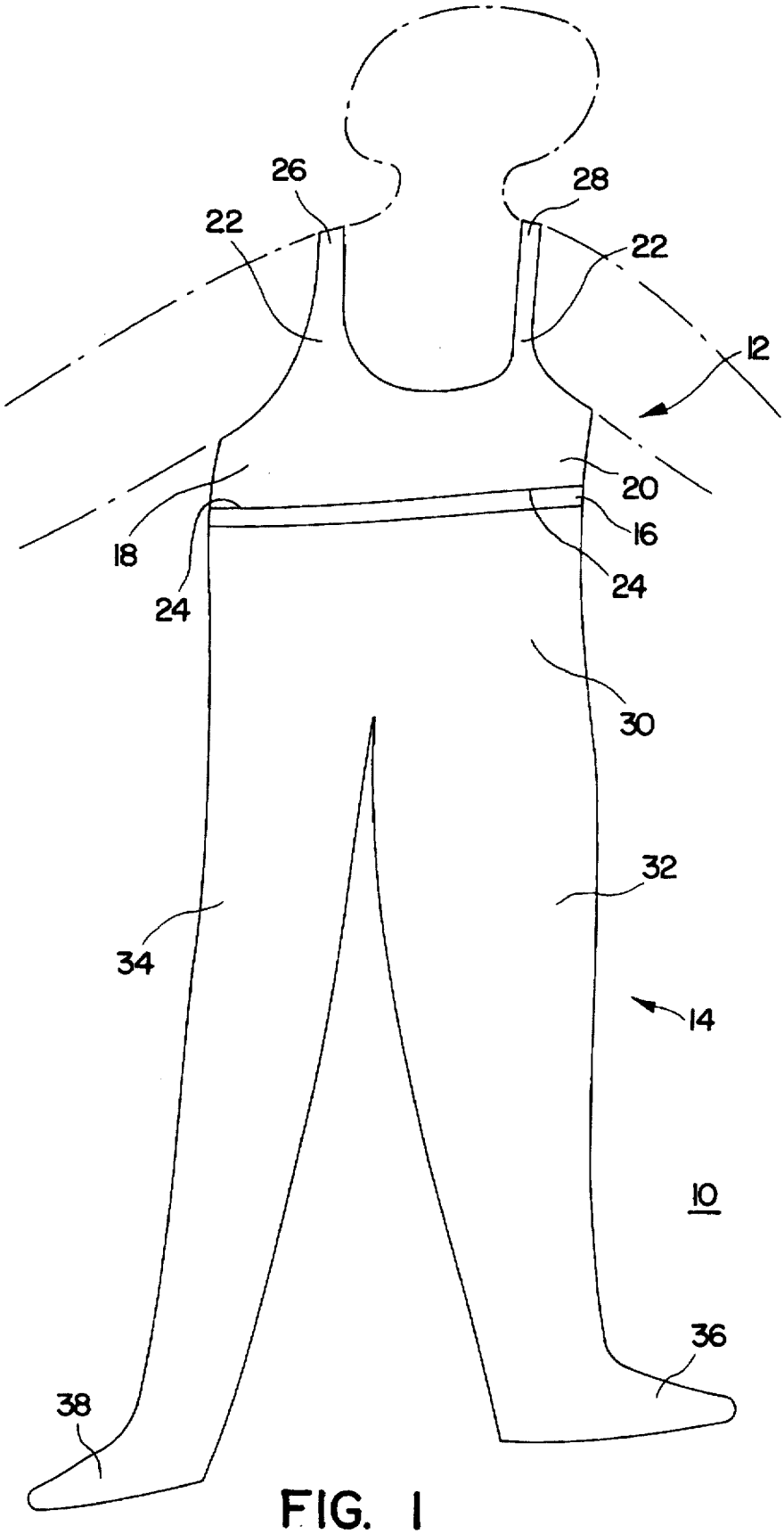
FIG. 1 is a front view of an exercise garment in accordance with the invention.

FIG. 1 illustrates a front view of a one-piece, stretchable exercise garment 10 in accordance with the preferred embodiment of the invention. The exercise garment 10 is adapted for use by females. The most desirable embodiments of the garment 10 are fabricated of light, sheer materials as described below. These materials permit the garment to be worn unseen under other garments. However, while the garment 10 is intended as a foundational undergarment, the garment 10 can be made of heavier materials to provide an external garment.

The exercise garment 10 includes an upper portion 12, a lower portion 14, and a connecting member 16 disposed between the upper portion 12 and the lower portion 14. The connecting member 16 connects or joins the upper portion 12 to the lower portion 14. The connecting member 16 can be an elastic support member such as an elastic band disposed around the torso of a user. The connecting member 16 is desirably positioned immediately below the breasts of a female user. The connecting member 16 can be integrally formed with the upper portion 12 to provide support for the breasts of the upper portion. Similarly, the connecting member 16 can be integrally formed with the lower portion 14 to provide a waistband. The preferred connecting member 16 is a continuous band about the midriff of a user. Desirable embodiments of the connecting member 16 can include a band of at least two discontinuous connecting members (not shown).

The upper portion 12 functions as a bra and supports the breasts of a user. The upper portion 12 can include a pair of breast support cups 18 and 20, each having a support cup top 22 and a support cup bottom 24. A lower portion of each support cup bottom 24 is connected to connecting member 16. Each support cup top 22 of the cups 18 and 20 is connected to a respective support strap 26 and 28. The other end of each support strap 26 and 28 is connected to the back of the connecting member 16.

The upper portion 12 can be fabricated from light, sheer, stretchable fabric materials, particularly when the garment 10 is exclusively for use as an undergarment. Desirable synthetic materials for fabricating the upper portion 12 are those sold under the tradenames LYCRA, NYLON, TRICOT, SPANDEX, and combinations thereof. Some commercially available weaves of cotton and cotton blends are desirable for fabricating the upper portion 12. When the garment 10 is intended for use without a covering garment, the upper portion 12 can be fabricated from heavier weaves of the materials described above.

Figure 2:
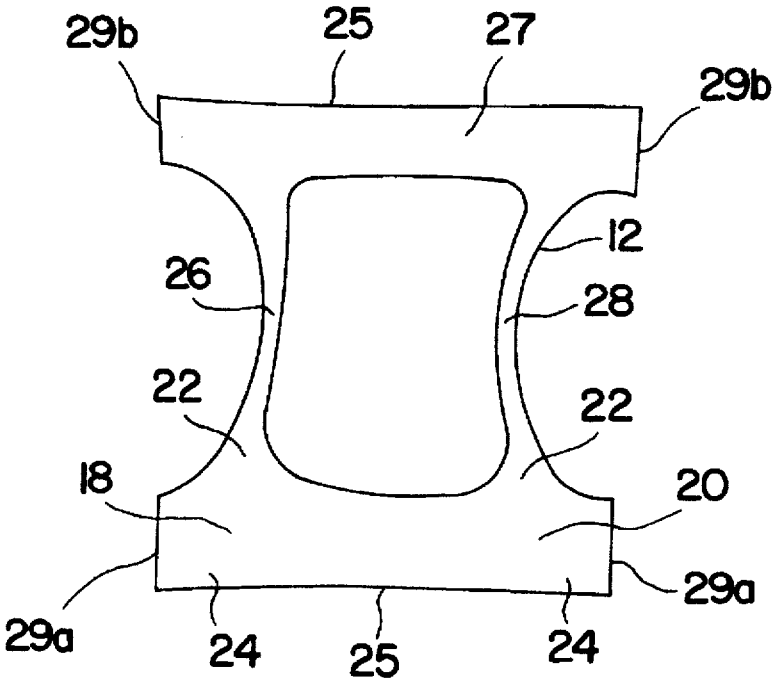
FIG. 2 is a plan view of the upper portion of the exercise garment of FIG. 1.

FIG. 2 is a plan view of the preferred embodiment of the upper portion 12 before it is assembled. This embodiment is formed from a very sheer, flat piece of material. The upper portion 12 is formed by sewing each of two side seams **29*a* of the cups 18 and 20 to its respective one of two side seams 29*b* of the back 27 of the upper portion 12. When the side seams are sewn, a continuous waist edge 25 is formed. All or part of the waist edge 25 can be sewn or joined in the connecting member 16. The cups 18 and 20** of the preferred embodiment are flat until the garment is donned by a user. The elastic material used with the preferred embodiment of the invention permits formfitting cups to envelop the breasts of the user.

The lower portion 14 desirably covers the lower torso, legs, and feet of a user. Desirable embodiments of the lower portion 14 can be tights or leotard-type coverings. The connecting member 16 is disposed at the top edge of the lower portion 14 and functions substantially as a waistband means for the lower portion 14. The lower portion 14 desirably includes a brief portion 30, leg covering portions 32 and 34, and foot portions 36 and 38. The lower portion 14 can be fabricated from light, sheer, stretchable fabric materials, particularly when the garment 10 is intended for use as an undergarment. Preferred materials for fabricating the lower portion 14 can be the same as the materials described above for the upper portion 12. However, the lower portion 14 or "panty" is desirably made from a heavier or thicker weave of material.

The upper portion 12 and the lower portion 14 are connected together at the connecting member 16. In use, a user engaging in vigorous exercise, such as rapid, repeated bending and stretching, subjects the upper portion 12 and lower portion 16 to stresses in opposite directions. If the upper portion 12 and the lower portion 14 were not connected, the upper portion 12 would tend to "ride up" or creep over the breasts of the user. Similarly, the lower portion 14 would tend to "ride down" or creep lower onto the hips of the user. The connecting member 16 permits the upper portion 12 and the lower portion 14 to cooperate and maintain each other in their respective correct positions during exercise. The forces or stresses causing the upper portion 12 to ride up over the breasts are countered with similar forces causing the lower portion 14 to slide down onto the hips. As a result, both the upper portion 12 and the lower portion 14 maintain their correct relative position to one another during vigorous exercise.

Figure 3:
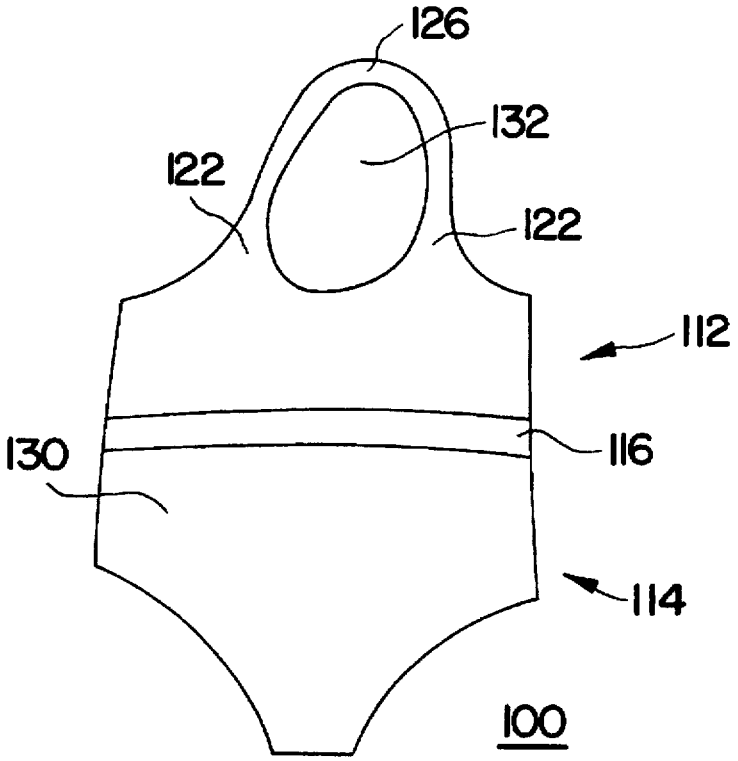
FIG. 3 is a front view of an alternative embodiment of an exercise garment in accordance with the invention.

FIG. 3 is a front view of an alternative embodiment of a one-piece, stretchable exercise garment 100 in accordance with the invention. The exercise garment 100 includes an upper portion 112, a lower portion 114, and a connecting member 116 disposed therebetween. The connecting member 116 connects the upper portion 112 of a first material, such as LYCRA, to the lower portion 114 of a second material, such as cotton. The lower portion 114 includes a panty brief 130 covering the lower torso of a user. The panty brief 130, while not subjected to as many stresses as the leotard bottom described above, still tends to move during vigorous exercise. This movement is reduced or eliminated by the invention as described above. Moreover, the movement offsets the tendency for the upper portion 112 to "ride up" as described above. This embodiment has a discontinuous connecting member 116 to provide a bare midriff portion.

The upper portion 112 includes a single support strap 126 connected to two top portions 122 of breast support cups 118 and 120, respectively. The top portions 122 and the support strap 126 define a loop or an opening 132 through which the head and neck (not shown) of the user pass. The support strap 126 rests on the back of the user's neck.

The connecting member of the invention is desirably a stiff, flexible stretch material. The connecting member can be made by rolling the two edges of the joined upper portion and lower portion together and sewing the rolled portion to form a belt-like member. The connecting member is desirably smooth and flat enough to not protrude below an outer garment. However, the connecting member, whether a continuous belt-like member or a discontinuous member, must be positioned to permit the upper portion of the garment to support the breasts of a user. Therefore, the most desirable embodiments of the garment position a continuous connecting member immediately below the breasts of a user.

I claim:

1. A one-piece support garment comprising:

an upper-torso member, said upper-torso member has a front portion to provide cups, said upper-torso member is fabricated from stretchable fabric, said cups each have a top portion and a bottom portion, said top portions are integrally connected to at least one strap, said bottom portions of said cups are attached to a connecting member, said at least one strap is connected between said top portions of said cups, said at least one strap is adapted for wear around a neck of a user;

a lower-torso member, said lower-torso member having a panty, leg and foot portions; and said connecting member, said connecting member is a flat, continuous elastic band immediately below said cups of said upper torso member and joins said upper-torso member and said lower-torso member, said connecting member with said upper-torso member provides a bra, said connecting member enables said upper-torso member and said lower-torso member to cooperate under stress to maintain their respective positions.

2. A stretchable exercise support garment comprising:

a flat, elastic connecting band;

an upper-torso breast support member including a bra, said upper-torso breast support member is continuously connected to said flat, elastic connecting band, said bra comprises two breast support cups, each of said two breast support cups has a top portion and a bottom portion, said garment has at least one support strap, said bottom portion of each of said support cups is attached to a flat elastic connecting band and said at least one support strap is connected between said top portion of each of said support cups, said support strap is adapted for wear around a neck of said user; and a lower-portion member, said lower-torso member is connected to said flat, elastic connecting band and said lower torso member having panty, leg and foot portions;

whereby said upper-torso breast support member and said lower-torso member cooperate through said flat, elastic connecting band to maintain their respective positions on a user during exercise and said flat, elastic connecting band is immediately below said bra.

3. The exercise support garment of claim 2 wherein said elastic connecting band is adapted to provide breast support with said upper-torso breast support member.

* * * * *